United States Patent [19]

Niemi

[11] Patent Number: 4,919,339

[45] Date of Patent: Apr. 24, 1990

[54] METHOD AND APPARATUS FOR IMPROVING THE GRINDING RESULT OF A PRESSURE CHAMBER GRINDER

[75] Inventor: Jouko Niemi, Pirkkala, Finland

[73] Assignee: Oy Finnpulva AB, Pirkkala, Finland

[21] Appl. No.: 267,124

[22] PCT Filed: May 6, 1987

[86] PCT No.: PCT/FI87/00061

§ 371 Date: Oct. 31, 1988

§ 102(e) Date: Oct. 31, 1988

[87] PCT Pub. No.: WO87/06854

PCT Pub. Date: Nov. 19, 1987

[30] Foreign Application Priority Data

May 9, 1986 [FI] Finland ..... 861961

[51] Int. Cl.[5] ..... B02C 19/06

[52] U.S. Cl. ..... 241/5; 241/29; 241/39; 241/152 A

[58] Field of Search ..... 241/5, 29, 39, 40, 152 A, 241/152 R, 194, 195, 24, 79.1, 189 R, 188 R, 101.3, 275

[56] References Cited

U.S. PATENT DOCUMENTS

| | | | |
|---|---|---|---|
| 3,860,184 | 1/1975 | Acton | 241/275 |
| 4,586,661 | 5/1986 | Niemi | 241/152 R X |
| 4,811,907 | 3/1989 | Niemi et al. | 241/152 R X |

FOREIGN PATENT DOCUMENTS

| | | |
|---|---|---|
| 2225417 | 5/1973 | Fed. Rep. of Germany . |
| 69255 | 9/1985 | Finland . |
| 72896 | 4/1987 | Finland . |
| 131574 | 3/1975 | Norway . |
| 1146080 | 3/1985 | U.S.S.R. . |

OTHER PUBLICATIONS

*Machines and Equipment for Ceramics and Refractory Producing Plants*, Mashinostroenie, Moscow, 1968; pp. 62–63.

*Primary Examiner*—Mark Rosenbaum

*Attorney, Agent, or Firm*—McGlew & Tuttle

[57] ABSTRACT

The invention concerns a method and an apparatus for improving the grinding result of a pressure chamber grinder. According to the method the finely divided material to be ground is fed by means of a mechanical feeder device (1) into a pressurized equalizing tank (2), the possibly clodded material is made loose by means of a rotor in the equalizing tank, and the material thus made loose is transferred into a pre-grinder (3), wherein several grinding-gas jets are applied to the material to be ground so that the material to be ground is fluidized, the fluidized material-gas flow is passed into a bisecting device (6), wherein it is divided into two component flows of equivalent magnitude and composition, each component flow is passed into the main grinding chamber (9) through a long accelerating nozzle (8) of its own, which said nozzle is directed so that a collision zone for the two component flows is formed in the center point of the said main grinding chamber. The method is characterized by that a solids-gas mixture ground in the main grinding chamber (9) is passed through an acceleration tube (10) into a mechanical grinder (11) in a direction corresponding to the rotation direction of the grinder rotor (13) driven by an electric motor (12), whereby pivotably mounted grinding hammers of the grinder are arranged to break up the coarser particles, moved to the outer periphery of the grinder, before their exit through a central out-flow (15) of the grinder.

5 Claims, 3 Drawing Sheets

Figure 1:
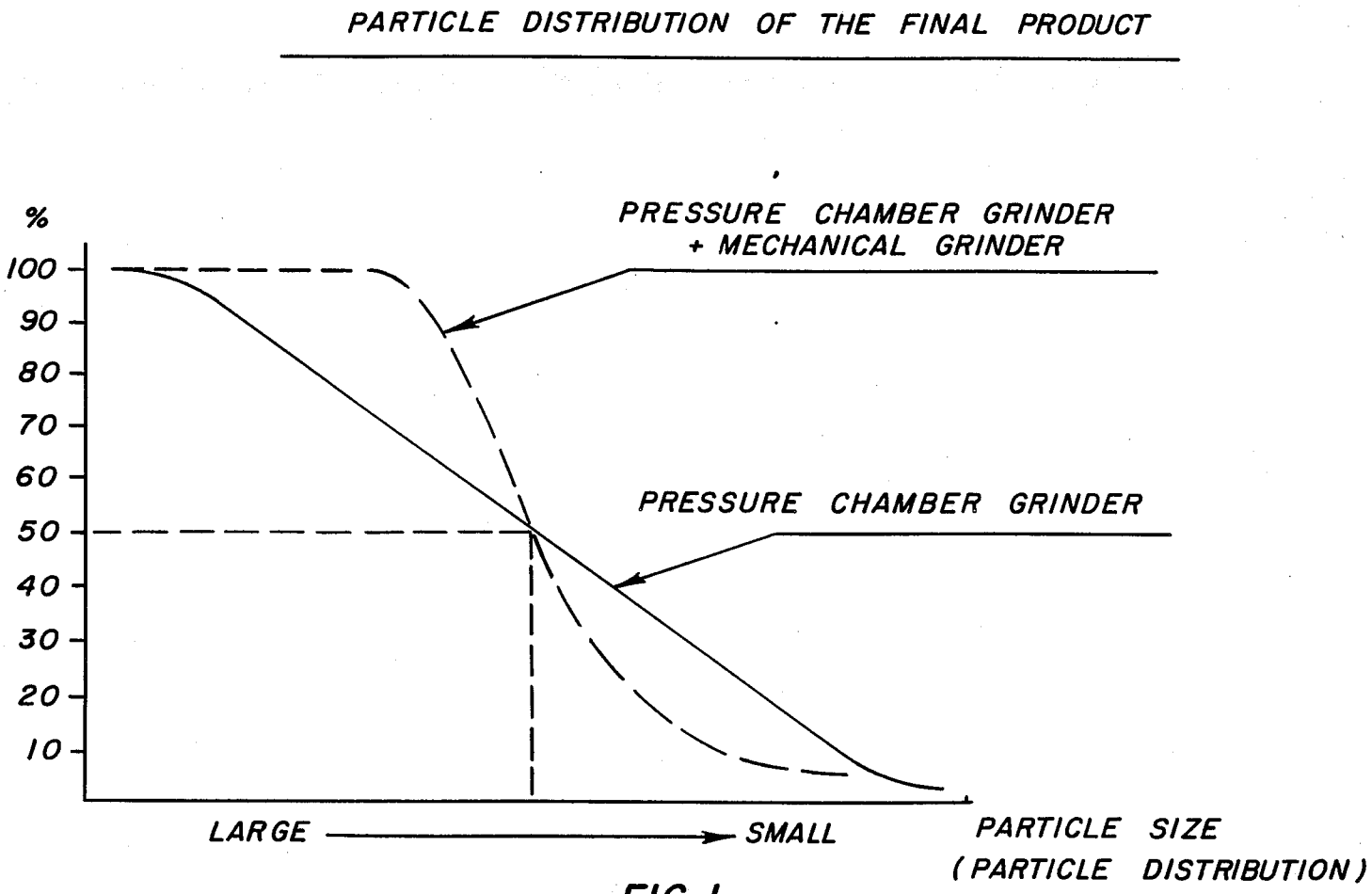

METHOD AND APPARATUS FOR IMPROVING THE GRINDING RESULT OF A PRESSURE CHAMBER GRINDER

The present invention is concerned with a method and an apparatus for improving the grinding result of a pressure chamber grinder. In the method finely divided material to be ground is fed by means of a mechanical feeder device into a pressurized equalizing tank, in the equalizing tank the possibly clodded material is made loose by means of a rotor, and the material thus made loose is transferred into a pre-grinder, wherein several grinding-gas jets are applied to the material to be ground so that the material to be ground is fluidized, the fluidized material-gas flow is passed into a bisecting device, wherein it is divided into two component flows of equivalent magnitude and composition, each component flow is passed into the main grinding chamber through a long accelerating nozzle of its own, which said nozzle is directed so that a collision zone for the two component flows is formed in the centre point of the said main grinding chamber.

It is an advantage of such a pressure chamber grinder that, as regards its energy economy, it is by far superior to conventional jet grinders, wherein ejectors are usually used as the feeder or accelerating device. Since in principle the material particles to be ground are subjected to the grinding effect only once, it is necessary to resort to a separate classifier in which the coarser particles are separated from the material-gas flow and returned, in one way or another, into the main grinding chamber for regrinding. In practice this mode of operation is usable when in the ground material the fraction having the final particle size is relatively small, and the unground material to be returned to the grinding, is high.

If instead the material fraction returned to the grinding is relatively small it is questionable whether the use of a separate classifier is motivated. The Finnish patent application No. 854671 discloses a solution for this kind of cases, according to which a pressure chamber grinder and a so called free-flow grinder a coupled in series. This system has proven to be especially suitable when the material ground in the pressure chamber grinder contains a very small fraction of unground material and when the material is of a very small particle size.

In practice it has been noticed that all such systems based on grinding the material solely using jet grinding techniques suffer from relatively high operating costs. Especially the grinding of a material containing after the pressure chamber grinder more than about 50% of a product of the final particle size involves unnecessary high costs if the previously mentioned equipment is applied. Among such materials can be named, for instance, paper fillers, such as talc, as well as various foodstuffs, such as for instance corn and cocoa.

The object of the present invention is to eliminate these problems. This has been achieved by means of a method which is characterized in that the material-gas mixture ground in the main grinding chamber is passed through an acceleration tube into a mechanical grinder in a direction corresponding to the rotation direction of the grinder rotor driven by an electric motor, whereby the pivotably mounted grinding hammers of the grinder are arranged to break up coarser particles, moved to the outer periphery of the grinder, before their exit through a central outflow of the grinder.

By using such a solution, the desired final result is obtained without a separate classifier or a secondary grinder of free-flow type, and in addition with essentially better energy economy. In the mechanical grinder the grinding conditions are chosen so that only the oversize particles are ground and the finer particles pass through this subsequent grinder almost without delay. The method and apparatus according to the invention is especially advantageous when an unusually high degree of fineness in the final product is not required and when the hardness of the material to be ground is not high. Thus, especially soft minerals and foodstuffs are suitable.

Figure 2:
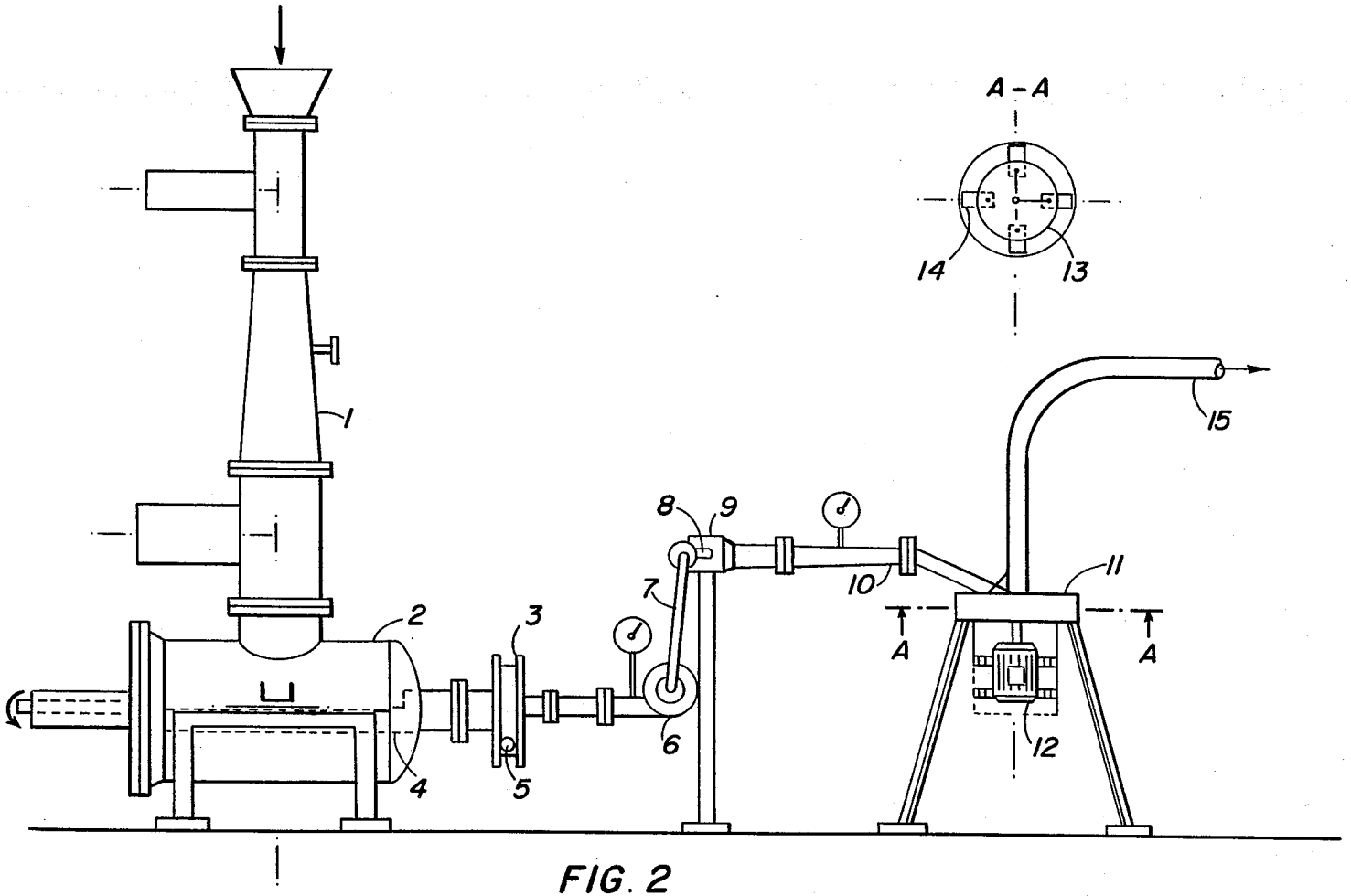
Figure 3:
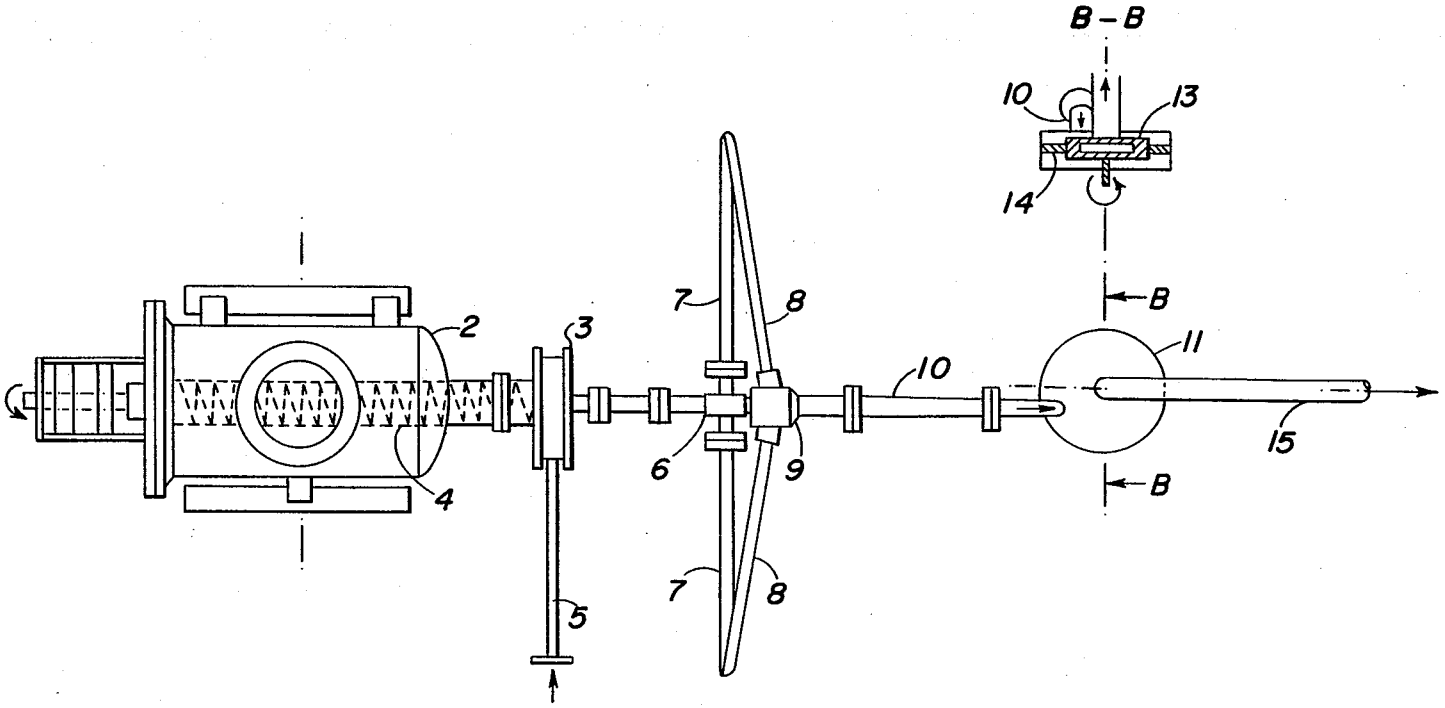

In the following, we will describe the invention in more detail with reference to the attached drawing, wherein FIG. 1 is a schematical illustration of the particle size distribution of the final product when a pressure chamber grinder alone is used, as well as when an embodiment in accordance with the present invention is used, FIG. 2 is a side view of an exemplifying embodiment of the apparatus of the present invention, and FIG. 3 is a top view of the apparatus, partly in section.

The apparatus in accordance with the invention comprises a mechanical feeder 1, which may be either a plug feeder, by means of which finely divided material to be ground is fed into a pressurized equalizing tank 2 as a gas-tight plug by means of a push piston, as is described in the Finnish patent application No. 84 4264, or a valve feeder, as is illustrated in FIGS. 2 and 3. The use of such a valve feeder is described, e.g. in the Finnish patent application No. 84 4028, so that its operation will not be described in further detail in this connection. The possibly clodded material is made loose by means of a rotor (not shown) in the equalizing tank and is transferred at a preset rate into a pre-grinder 3 by means of a screw conveyor 4. In the equalizing tank 2, approximately equal pressure is maintained as compared with the pre-grinder 3. In the pre-grinder 3, several strong grinding-gas jets are applied to the material to be ground, so that the material to be ground is fluidized. Grinding gas is passed into the pre-grinder through a gas pipe 5.

The fluidized material-gas mixture is made to rush from the pre-grinder 3 into a bisecting device 6, where the said material-gas jet is divided into two component flows of equivalent magnitude and composition. The two outlet pipes 7 of the bisecting device 6 are connected to the two long accelerating nozzles 8 of the pressure chamber grinder, which said nozzles are preferably shaped like venturi tubes. The accelerating nozzles 8 are directed so that the component flows rushing through them at an increasing velocity collide with each other in a collision zone formed in the middle point of the main grinding chamber 9. A highly efficient grinding of the material particles takes place in this collision zone. If, by chance, the coarsest particles in the material-gas mixture collide in the main grinding chamber 9 only against particles of a considerably smaller size, the grinding remains incomplete in respect of these coarser particles.

When the material-gas flow coming from the main grinding chamber 9 is passed through the accelerating tube 10 into the mechanical grinder 11 at a high velocity the material-gas mixture is forced into a rapid circulatory movement so that, by the effect of the centrifugal force, the coarsest particles remain in this grinder 11 longer and become ground by means of the grinding hammers 14 mounted on the rotor 13 and rotating at a high velocity, whereafter the ground particles escape through a centrally placed exhaust pipe 15.

The rotor 13 is driven by an electric motor.

The grinding conditions should preferably be chosen so that only the excessively large particles become ground in the mechanical grinder 11. By adjusting the grinding pressures so that a positive pressure of about 0.1 to 1.0 bar prevails in the main grinding chamber, the incoming velocity of the material-gas flow can be chosen to be suitably for the operation of the mechanical grinder.

The rotor 13 of the mechanical grinder 11 comprises advantageously two disc-like plates mounted at a mutual distance on the drive shaft, between which plates the grinding hammers 14 are tiltably mounted on pivot shafts located along the outer peripheries of the plates. The inlet orifice of the out-flow pipe 15 is thereby centrally placed between the rotor plates. By this arrangement it is guaranted that all material particles flowing into the mechanical grinder 11 are forced to flow through the operation zone of the grinding hammers 14.

The rotor 13 may also be of a multiple construction, whereby the evenly distributed grinding hammers 14 are situated in these layers, one placed upon the other, and between each layer is placed a disc-like intermediate plate. This construction improves markably the grinding capacity of the mechanical grinder.

In order to guarantee the best possible flow conditions the inlet orifice of the mechanical grinder is of a smaller diameter than its exit orifice.

In order to improve the capacity of the pressure chamber grinder the outer surface of the rotor 13 top-disc may be furnished with essentially radial flanges, which accomplish a fan-effect in the mechanical grinder 11.

On the accelerating tube 10, the shape of which is preferably that of a venturi tube, a manometer may be installed in order to permit observation of the pressure prevailing in the tube 10.

From the graph of FIG. 1 it is clearly seen that the particle distribution obtained by means of a solution in accordance with the present invention is much steeper than that obtained using a pressure chamber grinder alone. The vertical parameter is the percentage of penetration of the final product, and the horizontal parameter is the particle size. Since both curves intersect each other at a penetration value of 50%, the average particle size obtained with both of the methods is the same.

What is claimed is:

1. Method for improving the grinding result of a pressure chamber grinder, wherein the finely divided material to be ground is fed by means of a mechanical feeder device (1) into a pressurized equalizing tank (2), the possibly clodded material is made loose by means of a rotor in the equalizing tank, and the material thus made loose is transferred into a pre-grinder (3), wherein several grinding-gas jets are applied to the material to be ground so that the material to be ground is fluidized, the fluidized material-gas flow is passed into a bisecting device (6), wherein it is divided into two component flows of equivalent magnitude and composition, each component flow is passed into the main grinding chamber (9) through a long accelerating nozzle (8) of its own, which said nozzle is directed so that a collision zone for the two component flows is formed in the centre point of the said main grinding chamber, characterized in that a solids-gas mixture ground in the main grinding chamber (9) is passed through an acceleration tube (10) into a rotary mechanical grinder (11) in a direction corresponding to the rotation direction of the grinder rotor (13) driven by an electric motor (12), whereby pivotably mounted grinding hammers of the grinder are arranged to break up the coarser particles, moved to the outer periphery of the grinder, before their exit through a central out-flow (15) of the grinder.

2. Method as claimed in claim 1, characterized in that the grinding pressures are adjusted so that a positive pressure of about 0.1–1.0 prevails in the main grinding chamber (9) enabling the velocity of the material - gas flow to the mechanical grinder to be selected so that only oversize particles are ground in the mechanical grinder.

3. Apparatus for improving the grinding result of a pressure chamber grinder, which said apparatus comprises a mechanical feeder device (1), a pressurized equalizing tank (2) jointly operative with the feeder, which said equalizing tank is provided with a rotor and with a screw conveyor (4) for carrying the material to be ground into a pre-grinder (3), into which the grinding gas is passed through a gas pipe (5), a bisecting device (6) provided at the outlet side of the pre-grinder (3), both of whose outlet pipes (7) are connected to long accelerating nozzles (8) of their own, terminating in the main grinding chamber (9) and being directed so that the material-gas jets rushing out of them collide against each other int eh centre point of the grinding chamber (9), characterized in that to the outlet end of the main grinding chamber (9), via an acceleration tube (10), a mechanical grinder (11) is connected, comprising a rotor (13) furnished with pivoted grinding hammers (14), in which grinder (11) the acceleration tube (10) terminates essentially tangentially, in the rotational direction of the rotor, and at the centre of which grinder an out-flow pipe (15) is provided for the ground final product.

4. Apparatus as claimed in claim 3, characterized in that the rotor (13) comprises two disc-like plates mounted at a mutual distance on the drive shaft, between which plates the grinding hammers (14) are tiltably mounted on pivot shafts located along the outer periferies of the plates, and that the inlet orifice of the out-flow pipe (15) is centrally placed between these two plates.

5. Apparatus as claimed in claim 3, characterized in that the acceleration tube (10) has a shape of venturi tube and a manometer is provided in order to observe of the pressure in the tube (10).

* * * * *